United States Patent [19]

McNally

[11] Patent Number: 4,949,996

[45] Date of Patent: Aug. 21, 1990

[54] SKI EQUIPMENT INCLUDING A MIRROR PANEL ATTACHMENT

[76] Inventor: Mark H. McNally, 155 Northwood Apartments, Sunderland, Mass. 01375

[21] Appl. No.: 316,815

[22] Filed: Feb. 28, 1989

[51] Int. Cl.[5] ..... A63C 5/06; A63C 11/00

[52] U.S. Cl. ..... 280/816; 280/607; D 21/229

[58] Field of Search ..... 280/607, 610, 636, 809, 280/813, 816, 87.042; 15/215, 216, 238; 362/128, 135; D 6/300, 303; D 21/229, 230; 273/35 A, 35 B

[56] References Cited

U.S. PATENT DOCUMENTS

| | | | |
|---|---|---|---|
| 477,564 | 6/1892 | Maxmilian | 15/238 |
| 2,125,319 | 8/1938 | Schlumbohm | 362/135 X |
| 3,567,237 | 3/1971 | Miller, III | 280/11 |
| 3,635,483 | 1/1972 | Barriball et al. | 280/610 |
| 3,861,699 | 1/1975 | Molnar | 280/610 |
| 4,409,287 | 10/1983 | Harrison | 280/610 X |
| 4,592,567 | 6/1986 | Sartor | 280/602 |
| 4,623,955 | 11/1986 | Santini | 362/135 |

FOREIGN PATENT DOCUMENTS

| | | |
|---|---|---|
| 0042994 | 1/1982 | European Pat. Off. . |
| 0207302 | 1/1987 | European Pat. Off. . |
| 1345704 | 11/1963 | France . |
| 242863 | 6/1946 | Switzerland . |
| 321915 | 5/1957 | Switzerland . |

*Primary Examiner*—Charles A. Marmor
*Assistant Examiner*—Brian L. Johnson
*Attorney, Agent, or Firm*—Lahive & Cockfield

[57] ABSTRACT

An improvement in ski equipment is provided wherein a mirror panel is placed in the upper surface of a snow ski or the like in the area where during use of the ski a ski boot is placed. The mirror panel has a sufficiently abrasion and wear resistant upper surface to insure that the reflective quality of the miror is preserved. By so placing the mirror panel, a skier can view the bottom of her ski boot as it is being placed onto the ski to insure that the ski boot is free from snow and other debris.

5 Claims, 1 Drawing Sheet

SKI EQUIPMENT INCLUDING A MIRROR PANEL ATTACHMENT

BACKGROUND OF THE INVENTION

This invention relates in general to snow ski equipment and more particularly to a mirror element for incorporation in, or on the upper surface of, the ski in the binding area.

In typical skiing activity skiers will from time to time be stepping out of and into their bindings. It is desirable, both from performance and safety considerations, to have the sole of the boot substantially free of snow at the time that the skier steps onto the ski and engages the bindings. This is conventionally accomplished by the skier standing on one foot, turning the sole of the boot on the other foot up to examine the lower surface and then stepping into the binding on the corresponding ski. The process is repeated for the other foot and the other ski. This is, of course, somewhat awkward and, on those occasions when there is no snow on the bottom of the boot it wastes time. Alternatively, the skier may omit this precaution and become involved in engaging or trying to engage the binding with snow on the bottom of the boot.

SUMMARY OF THE INVENTION

It is the object of the present invention to provide, either as original equipment, or as a retrofit, a rigid reflecting surface on the upper surface of the ski in the area where the boot will step for engagement to the binding. This reflecting surface, typically formed of polyester film with a metal coating, serves as a mirror enabling the skier to observe the ski boot bottom just as it is being placed on the ski.

DESCRIPTION OF THE DRAWINGS

In the drawings:

With reference to FIG. 1, there is shown the body of a ski 10 which is formed as a conventional snow ski formed of fiberglass, aluminum or other composite or laminated materials, and having a conventional binding including toe and heel pieces 12 and 14 respectively. While illustrated as a downhill ski, this could also be a cross-country ski or a snowboard. Incorporated in the upper surface of the ski is a reflecting panel 16 having a sufficiently high coefficient of reflection to serve as a flat mirror enabling a skier to observe a reflection from it at a distance of several feet. This reflecting element 16 may be formed, for example, of silver or other reflective material, either coated on the lower side of a rigid polymer film adhered to the upper surface of the ski, or incorporated into the upper body of the ski, and then coated with any clear, tough, protective coating. In one embodiment, suitable as a retrofit panel, a 2½ inch by 5 inch long 3 mm thick panel of metallized polyester, such as that obtained from Flexcon Inc. of Spencer, Mass. under the designation Flexmark MM-300-S is fastened to the ski surface with suitable adhesive. Alternatively the panel could be fastened with screws.

With such a panel the ski boot, as it is placed into the binding by the skier, has its sole reflected in the mirror, indicating to the skier the presence of any snow or other undesirable materials on the bottom of the boot.

If desired, logos or other decorative or informational material may be printed on the reflecting surface, provided that it does not interfere with the basic function of the mirror element.

Figure 1:
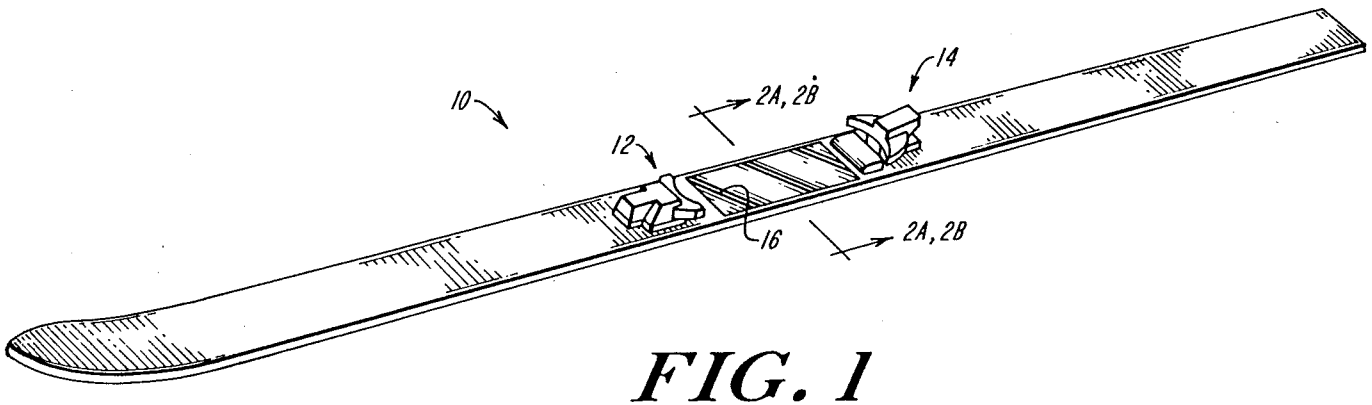
FIG. 1 is an illustration in generally perspective view of a ski incorporating the reflecting mirror of this invention in the upper surface.
Figure 2B:
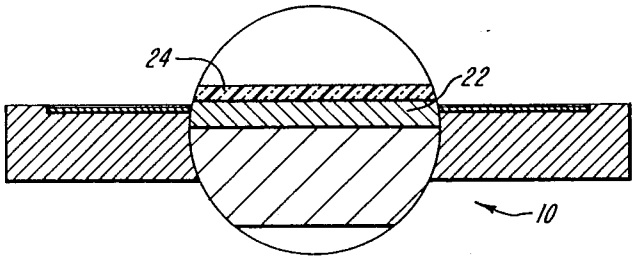
FIG. 2 is a cross sectional view of the embodiment of FIG. 1.
FIG. 2A is an illustration of the cross sectional view of a retrofit reflecting panel in accordance with this invention.

In FIGS. 1 and 2, the embodiment of the invention has been shown as a reflecting element essentially manufactured with the ski and provided as an intrinsic construction element of a new ski. In FIG. 2 there is illustrated a cross sectional view showing the ski 20 with a reflective metal layer 22 (which could, for example, be silver) covered by a protective coating or film 24.

Figure 2A:
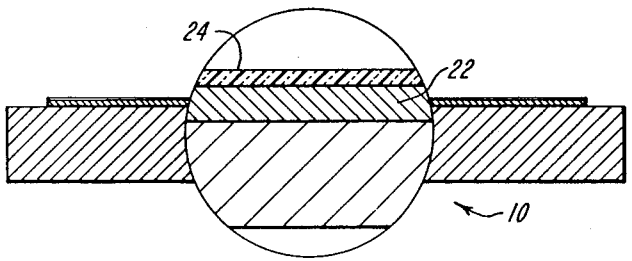

Alternativley, as illustrated in FIG. 2A this reflective element may be retrofited by means of adhering a suitable material including the reflective surface 22 and protective surface 24, by adhesive or other suitable bonding mechanism to the upper surface of the ski in the region between the binding heel and toe piece. While this region is preferred the reflective element could be located anywhere on the upper surface of the ski where it can be readily employed for its purpose of providing an image of the boot sole.

While specific embodiments have been described, it will be understood that the invention herein is set forth in the following claims.

I claim:

1. In a snow ski having a ski binding area on an upper surface for placement and retention of a ski boot during the use of said ski, the improvement comprising;

a mirror panel placed on the upper surface of said ski within the ski binding area and forming a portion thereof, said mirror panel having an upper surface sufficiently resistive to abrasion and wear to maintain the mirror quality of said panel, and being of sufficient size to provide an image of the sole of said ski boot.

2. A snow ski improvement in accordance with claim 1 wherein said mirror panel is formed of a reflecting metal surface covered with a coating or film of optically clear polymeric material

3. A snow ski improvement in accordance with claim 1 wherein said mirror panel is formed of a clear film of polymeric material, having adhered to one side, a highly reflective material forming a mirror surface and wherein said film is placed with the reflective material side adjacent to the body of the ski in the area where said ski boot is to be placed.

4. A panel in accordance with claim 3 and having means for adhering said panel to the upper surface of a snow ski.

5. A mirror panel for placement on a snow ski having a ski binding area on an upper surface thereof comprising a highly reflective mirror surface applied to a coating of abrasive and wear resistant material, said coating being optically transparent wherein said mirror surface is located within said binding area.

* * * * *